US011663995B2

(12) United States Patent
Smullen et al.

(10) Patent No.: US 11,663,995 B2
(45) Date of Patent: May 30, 2023

(54) STRINGED INSTRUMENT WITH TRANSLATED STRINGS WITH ADJUSTABLE TENSION

(71) Applicant: Devon Bass, Boerne, TX (US)

(72) Inventors: Devon Smullen, Boerne, TX (US); Gary Richter, Oak Creek, WI (US)

(73) Assignee: Devon Bass, Boerne, TX (US)

( * ) Notice: Subject to any disclaimer, the term of this patent is extended or adjusted under 35 U.S.C. 154(b) by 143 days.

(21) Appl. No.: 17/135,377

(22) Filed: Dec. 28, 2020

(65) Prior Publication Data

US 2022/0208151 A1 Jun. 30, 2022

(51) Int. Cl.
*G10D 3/12* (2020.01)
*G10D 3/06* (2020.01)

(52) U.S. Cl.
CPC ..... *G10D 3/12* (2013.01); *G10D 3/06* (2013.01)

(58) Field of Classification Search
CPC .. G10D 3/14; G10D 3/10; G10D 1/05; G10D 3/12; G10D 3/06; G10D 1/085; G10D 3/00; G01L 5/047; G01L 5/06; G01L 5/042; G10G 7/00
See application file for complete search history.

(56) References Cited

U.S. PATENT DOCUMENTS

2008/0229895 A1* 9/2008 Beckwith ..... G10D 3/12 84/291

OTHER PUBLICATIONS

Pinterest; https://www.pinterest.com/pin/228698487316371903/; "Neutral-Tension-Bridge"; image ploaded (Feb. 2020).
DK Guitars; http://dkguitars.com/innovations/; "Innovations" page; (2014).
Babicz Guitars; http://www.fullcontacthardware.com/; "Full Contact Hardware" page; (2020).
Babicz Guitars; http://www.fullcontacthardware.com/spider-acoustic; "Full Contact Hardware" page; Babicz Identity Series Spider Acoustic, Model: ID-SPIDER-06e; (2020).
guitarmeet.com; https://www.guitarmeet.com/what-are-the-different-kinds-of-electric-guitar-bridges/; "What are the Different Kinds of Electric Guitar Bridges"; (2020).
(Continued)

*Primary Examiner* — Kimberly R Lockett
(74) *Attorney, Agent, or Firm* — FisherBroyles LLP; Kevin D. Jablonski

(57) ABSTRACT

Systems and methods for translating strings of a stringed instruments as well as providing for adjustable tensioning. In embodiments, a stringed instrument, may include an instrument body having a front side and a back side wherein, as with most stringed instruments, the strings are disposed on the front side of the body for playing. Different from conventional stringed instruments though, at least a portion of at least one string may be disposed on the backside of the body as well. Thus, a first set of string anchor points are disposed on front side and a second set of string anchor points are disposed on the back side. That is, the strings are translated form the front side to the back side by passing the one or more translated strings through an aperture in the body called a through-bridge. Further, embodiments may include additional versatility by having adjustable tensioning systems.

15 Claims, 6 Drawing Sheets

(56) References Cited

OTHER PUBLICATIONS

Stewart-MacDonald; stewmac.com; https://www.stewmac.com/parts-and-hardware/bridges-and-tailpieces/; "Bridges + Tailpieces"; (2020).
amazon.com; https://www.amazon.com/LR-Baggs-T-Bridge-Acoustic-Matic/dp/B004P9599Y/ref=sr_1_2?dchild=1 &keywords=lr+baggs+t-bridge+acoustic+tune-o-matic+bridge+pickup+gold&qid=1608244805 &sr=8-2; LR Baggs T-Bridge Acoustic Tune-O-Matic Bridge Pickup Gold; (2020).
Travelerguitar.com; https://travelerguitar.com/products/ultra-light-edge-bittersweet-orange-molten-lava?fbclid=lwAR3K31ElGedA80Ag5mkHbo4J2FzDdzCjBT9iHR87ZBX8tFgnceS1_EGbjqA; Ultra-Light EDGE (Bittersweet Orange & Molten Lava); (2020).

* cited by examiner

STRINGED INSTRUMENT WITH TRANSLATED STRINGS WITH ADJUSTABLE TENSION

BACKGROUND

Listening to and performing music is enjoyed by billions of people across the world and playing instruments has been a professional and recreational pursuit for many people who enjoy music. One particular subset of musical instruments that are prevalent in the music industry today include any number of stringed instruments. Stringed are musical instruments that produce sound from vibrating strings when the performer plays or sounds the strings in some manner. Musicians play some string instruments by plucking the strings with their fingers or a pick while others may be played by hitting the strings with a striker or hammer or by rubbing the strings with a bow. Typical stringed instruments include guitars and violins. Further, stringed instruments may often have a specific scale length that defines a portion of a taut string that vibrates to produce desired sounds. The scale length is related to the "speaking length" of the string; the speaking length is the part of the string that vibrates to produce a desired note (e.g., frequency). A typical instrument string includes a ratio of string diameter to scale-length needed to produce desired tones. Generally, the shorter the scale-length, the larger the diameter string is needed to produce the same frequency.

In most stringed instruments, the vibrations are transmitted to the body of the instrument, which often incorporates some sort of hollow or enclosed area. The body of the instrument also vibrates, along with the air inside it. The vibration of the body of the instrument and the enclosed hollow or chamber make the vibration of the string more audible to the performer and audience. The body of most string instruments is hollow, however, more modern stringed instruments, such as the electric guitar, utilize electric pick-ups that generate electronic amplification that allows for a solid wood body.

With all stringed instruments, the strings used are affixed to the instruments at anchor points positioned at two or more points such that the string can be taut, thereby able to produce a vibration at a specific frequency when played. As lower and lower notes are desired for a specific instrument, the length and size of the string increases. As such, bass instruments require longer bodies and necks to accommodate the longer and larger-diameter string. Further, the string length will also vary from string to string as the longest strings are intended to produce the lowest frequency notes but are typically not desired for playing higher-frequency notes, so additional strings with shorter run lengths are also included in most stringed instruments (e.g., a 4- or 5-string bass guitar, a 6- or 12-string guitar, and the like.) Shortening the string run length would allow for smaller instruments that still produce the desired range of frequencies.

BRIEF DESCRIPTION OF THE DRAWINGS

Embodiments of the subject matter disclosed herein in accordance with the present disclosure will be described with reference to the drawings, in which.

Note that the same numbers are used throughout the disclosure and figures to reference like components and features.

DETAILED DESCRIPTION

Figure 1:
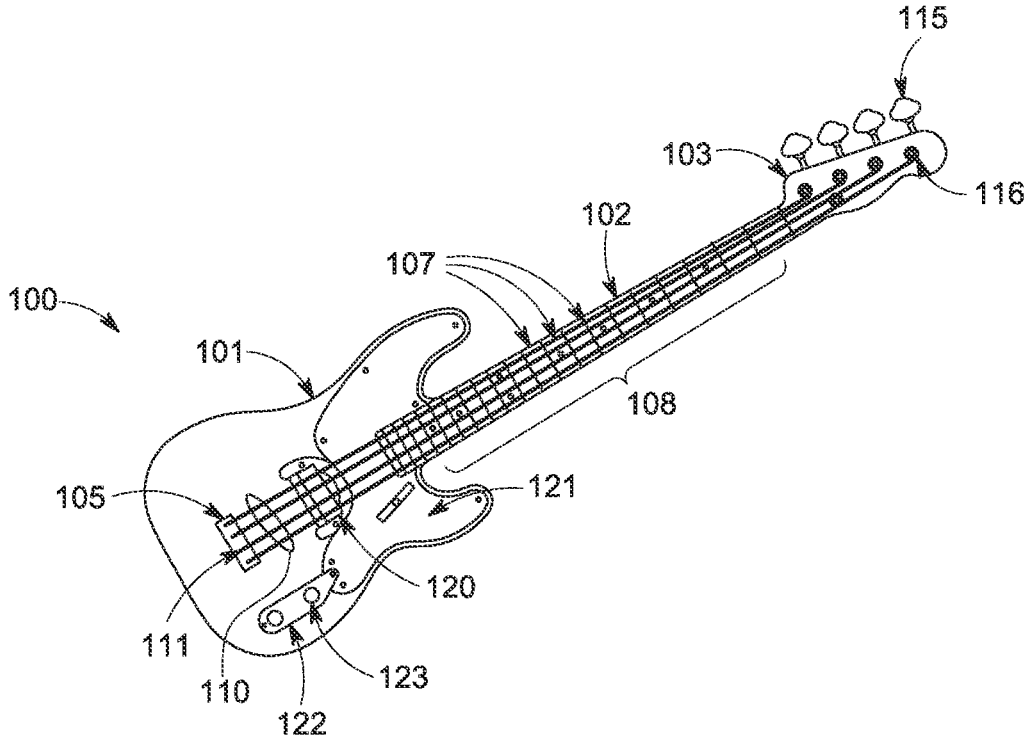
FIG. 1 Prior Art
FIG. 1 is a diagram of a conventional bass guitar having a conventional string bridge.

The subject matter of embodiments disclosed herein is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments will be described more fully hereinafter with reference to the accompanying drawings, which form a part hereof, and which show, by way of illustration, exemplary embodiments by which the systems and methods described herein may be practiced. This systems and methods may, however, be embodied in many different forms and should not be construed as limited to the embodiments set forth herein; rather, these embodiments are provided so that this disclosure will satisfy the statutory requirements and convey the scope of the subject matter to those skilled in the art.

By way of an overview, the systems and methods discussed herein may be directed to systems and methods for translating strings of a stringed instruments as well as providing for adjustable tensioning. In an embodiment, a stringed instrument, may include an instrument body having a front side fand a back side wherein, as with most stringed instruments, the strings are disposed on the front side of the body for playing. Different from conventional stringed instruments though, at least a portion of at least one string may be disposed on the backside of the body as well. Thus, a set of one or more first string anchor points are disposed on front side of the body and then a set of one or more second string anchor points are disposed on the back side. That is, the strings are translated form eth front side to the back side. The instrument achieves this by passing the one or more translated strings through an aperture in the body—called a through-bridge.

Further, each string, once translated, may be anchored in a string return cavity on the back side of the body at one of a plurality of variable anchor points. Different devices and systems are presented herein whereupon string ball end may engage with receivers for holding the end of the string in place on the back side. These back-side anchors have adjustable positions and, thus, may be maneuvered to attain different level of tension on the string. With translated strings and adjustable tension, a world of versatility is opened for players who prefer strings with longer lengths are strings with larger or smaller diameter because the choice of strings is no longer limited by the instrument scale length.

The embodiments discussed herein may be practiced with any number of stringed instruments including acoustic and electric guitars, acoustic and electric bass guitars, banjos, violins, violas, cello, mandolins, and the like. Further, any number of strings may utilize one or more features as disused herein including instruments with only one string or up to a great number of strings, such as hammered dulcimers or harps.

FIG. 1 is a diagram of a conventional bass guitar 100 having conventional means of anchoring strings 110 at a string bridge 105 such that the string positions are not adjustable adjacent to the bridge 105. Further, the strings 110 are not translated beyond the relative string plane of the front side of the bass guitar 100. As shown in FIG. 1, a conventional stringed instrument 100 is shown to illustrate the drawbacks of a typical stringed instruments. While FIG. 1 shows a bass guitar 100, a skilled artisan understands that these concepts illustrated here apply to any conventional stringed instrument. Further, the skilled artisan will also appreciate the application of the novel concepts discussed herein as also applying equally to any stringed instrument. As such, the reminder of this detailed description will remain focused on the application to a bass guitar 100 for brevity.

In FIG. 1, a bass guitar 100 is shown having four strings 110 attached thereto. The strings 110 are attached at a first anchor point 111 that is situated on an anchor bridge 105 disposed on the front face of a body 101. The other end of each string 110 is coupled to a second anchor point located at a head stock 103 at and end opposite the body 105 such that each string spans a neck 102. The strings 110 span the neck 102 over a fretboard that includes frets that a player may use to play different notes. The strings 110 are typically coupled to a tuning device 115 that is configured to rotate a respective nut when one actuates one of four tuning keys 116. That is, a first string 110 may be tightened or loosened between the string bridge 105 and a first tuning device 116 by turning a first tuning key 115. Likewise, a second string 110 may be tightened or loosened between the string bridge 105 and a second tuning device 116 and by turning a second tuning key 115, and so on.

Each string 110 spans the neck 102 which includes a fretboard having frets 107. As a player places one or more fingers on each string 110, the string may make contact with a fret 107 and then, when struck or plucked, vibrate at a frequency commensurate with the distance between the fret 107 and a string anchor point 111 that is part of the conventional string bridge 105. As a player's finger moves up and down the fretboard (e.g., neck 102), different frets 107 may be engaged for each string 110, thereby producing a different vibrations frequency (e.g., a different note). In stringed instruments, the length of the fretboard defines the instrument's scale length. As alluded to above, longer-scale fretboards are best suited for instruments that are intended to play lower-frequency notes, whereas shorter fretboards are for instruments that play higher-frequency notes. A skilled artisan also understands that some stringed instruments are players without frets on a fretboard. Rather, the neck includes a fingerboard (e.g., a fretboard without frets) where a skilled artisan learns where to place fingers for producing desired notes without the precision of the fret.

Further, a typical bass guitar 100 will include an electronic pickup 120 that is configured to detect the vibration of each string and amplify the frequency of the sound. That is, a pickup 120 is, essentially a respective microphone disposed directly under each string 110. The audio signal detected may be further modified by circuitry controlled by a volume know 122 and a tone control knob 123. Further yet, the bass guitar body 101 may include a pickguard 121. A more detailed view of the string bridge 105 in the bass guitar of FIG. 1 is shown and described next with respect to FIG. 2.

Figure 2:
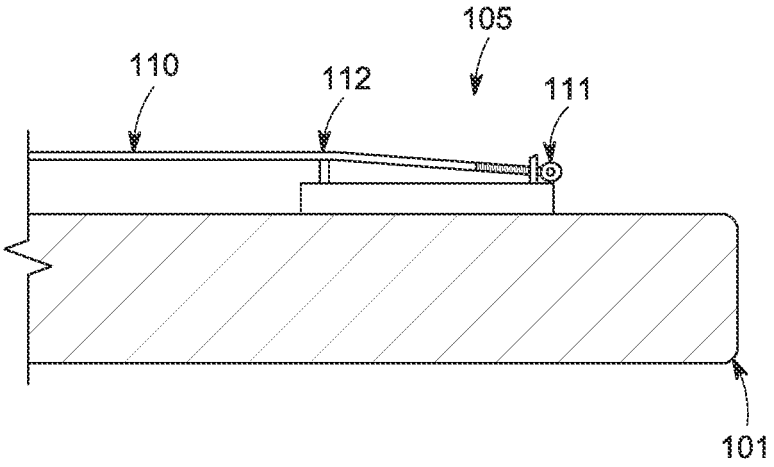
FIG. 2 Prior Art
FIG. 2 is a cutaway view of the string bridge of the conventional bass guitar of FIG. 1.

FIG. 2 is a cutaway view of the string bridge 105 of the conventional bass guitar of FIG. 1. As one can see, the string anchor point 111 for each string 110 remains affixed just above the face of the body 101. A typical stringed instrument may include one or more string guides 112 that assist with keeping each string 110 in position. Further, these strings guides 112 provide for a slight translation of direction for each string 110. As one can see in this example, the translation is about 10 degrees from a direction of string direction. That is, the string 110 between the bridge saddle 112 and the head stock tuning device (not shown) is a straight line, but the string 110 changes direction, (e.g., about 10 degrees downward) to then anchor at the bridge anchor point 111.

The conventional bass guitar shown in FIGS. 1 and 2 has drawbacks in that the string anchor points 111 for the strings 110 are at fixed points on the instrument body 101. Thus, for an instrument, like this bass guitar 100, to produce low notes, a long string must be used. Therefore, the instrument itself must accommodate the entire string run length from the bridge to the tuning devices. That is, the entity of the string run length is accommodated in virtually the same plane (i.e., notwithstanding small deviations in the string direction imparted by the bridge saddle, and the like) at the front side of the instrument 100. Further, each instrument is typically sized (e.g., instrument scale) to only accommodate a single version of strings suited to the instrument scale length. Thus, players are limited in string choices and tuning options in conventional stringed instruments. The drawbacks are addressed in the novel embodiments described below with respect to FIGS. 3-11.

Figure 3:
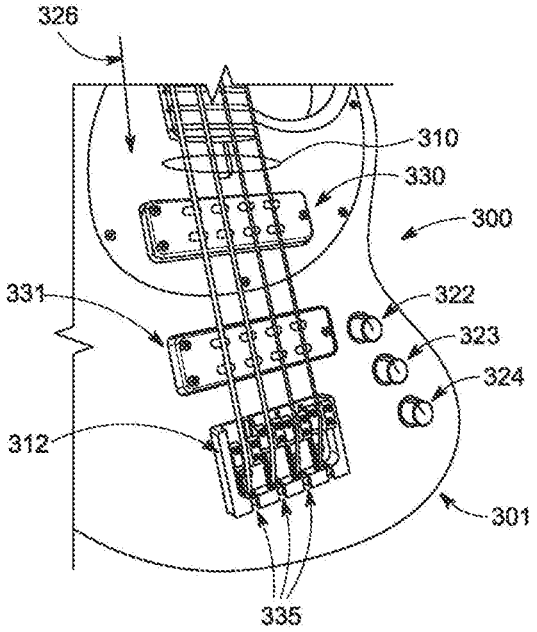
FIG. 3 is a cutaway front view of a bass guitar having string returns for translated strings according to an embodiment of the subject matter disclosed herein.
Figure 4:
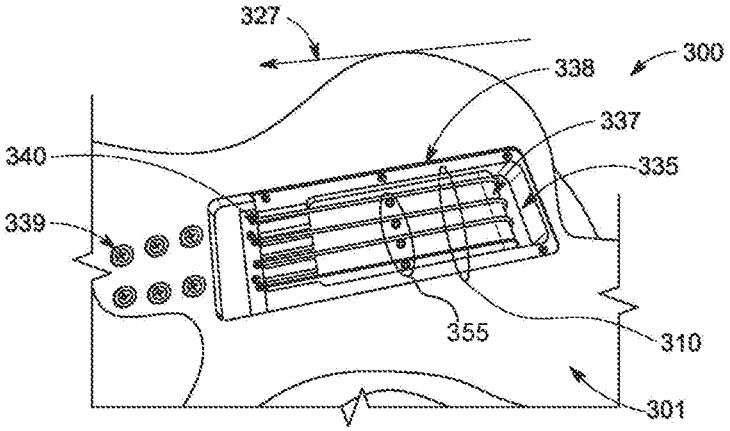
FIG. 4 is a cutaway rear view of the bass guitar of FIG. 3 having string returns for translated strings according to an embodiment of the subject matter disclosed herein.

FIG. 3 is a cutaway front view of a bass guitar 300 having a rear-body string return for translated strings according to an embodiment of the subject matter disclosed herein. In this embodiment, the body 301 of the bass guitar 300 includes one or more orifices 335 through which the strings 310 of the bass guitar 300 may pass through from the front side of the bass guitar body 301 to the rear side of the body 301. Thus, in this embodiment, the strings engage a through-bridge 312 whereby the strings engage the through-bridge 312 at the orifice 335 to then emerge at the back side of the body 301 thereby providing a rear-body string return for accommodating string with longer string length runs. In this manner, as will become evident in conjunction with FIG. 4 showing the rear side of the bass guitar body 301, the string direction 326 may be translated (e.g., returned) with respect to the first direction 326 in which the strings are disposed on the guitar 300. That is, the strings are anchored between a first anchor point at the head stock (not shown in FIG. 3) and eventually at a second anchor point (shown in FIG. 4) at the rear side of the body 301 but ultimately emanating in the opposite direction (327 as shown in FIG. 4) at the rear side of the body 301. Thus, prior to this second anchor point on the rear side, the strings 310 that started out emanating in the first direction 236 toward the through-bridge 312, ultimately extend in the second, opposite direction 327 on the rear side of the body 301. The culmination of this initial description is more evident with respect to FIG. 4.

FIG. 4 is a rear view of the bass guitar of FIG. 3 having a rear-body string return for translated strings according to an embodiment of the subject matter disclosed herein. Continuing the description from FIG. 3, the strings 310 can be seen emerging from the orifice 335 that is part of the through-bridge 312 to then extend in the second direction 327 (e.g., opposite the first direction 326 as shown in FIG. 3). The strings 310 emerge through the orifice 335 at the rear side of the guitar body 301 and are within the backplane of the body 301 inside a string return cavity 338. The string return cavity 338 includes space that is disposed within the body and having a rectangular opening in the back side of the guitar body 301. The string return cavity 338 is shown, in the embodiment of this FIG., as being open. In other embodiments, the string return cavity 338 includes a removable cover plate (not shown) to provide protection and aesthetic beauty to the guitar 301. Further, each string 310 is shown as anchored to a single, respective anchor point 340 at the far end (with respect to the orifice 335) of the rear string cavity 338. However, in other embodiments described below with respect to FIGS. 8-11, the strings may be anchored at variable positions in the string return cavity 338. Additional mechanical components (not shown in FIG. 4) provide for ease of maneuvering and setting each individual string anchor point to a desired location in the string return cavity 338. As shown here, the string return cavity 338 includes a far end is disposed just before neck bolts 339 that hold the neck to the body 301.

The guitar 300 of FIGS. 3 and 4 may further include first and second electronic pickups 330 and 331 disposed on the front of the guitar body 301 just below the strings prior to the strings are positioned through the orifice 305 in the through-bridge 312. In this embodiment, the orifice 305 may include four individual string holes through which each respective string 310 is threaded to the string return cavity 338. In other embodiments, the orifice 305 may be a single hole through the body 301 in which all four strings 310 pass though (spaced apart from each other. In any embodiment, as each string 310 is threaded though the orifice 305, each string 310 will be supported by a string translator 337 (sometimes called a string return) such that the string 310 is held tight against the string return 337 to form a gradual curve. This gradual return shape ensures that tension in the string remain axial to each string 310 (e.g., the forces acting on the string 310 as it is tightened are primarily parallel (i.e., longitudinal) with respect to the axis of the string 310 and forces are not concentrated at any sharp bend or turn. Thus, the string tension can remain consistent when the string 310 is plucked or struck after the respective strings 310 have been tuned.

The guitar 300 of FIGS. 3 and 4 may further include electronic control in the form of potentiometers or "knobs" that can control different aspects of the pickups 330 and 331. In this embodiment there are three knobs 332, 333, and 334, that may be overall gain, overall tone, first pickup gain, second pickup gain or any other electronic parameter typically able to be controlled in an electric stringed instrument. Additional elements of the guitar 300 may include a pickguard, an output jack, strap buttons, Further, the guitar body need not be the shape depicted in the embodiment shown in FIGS. 3 and 4, as any number of body shapes may accommodate the innovations described herein.

In an embodiment according to FIGS. 3 and 4, the stringed instrument may have a total string run length between a front side anchor point and a back-side anchor point wherein a distance between the front-side anchor point and the through bridge is about five to ten times greater than the distance between the through bridge and the back-side anchor point. Further, the string return cavity 338 may include an electronic pickup 355 disposed adjacent to the strings 310 such that additional harmonics or sympathetic tones resonant in the strings 310 may enhance or be added to the sounds produced when playing the instrument.

With a stringed instrument having the string return features and through-bridge that allow for translating strings 310 as shown in FIGS. 3 and 4, a number of advantages present over conventional stringed instruments. As a first advantage, because the overall string length is now longer, thus will enable longer strings to be used that are typically available for the instrument's scale length. For example, a conventional bass scale length may be 34 inches such that bass guitar strings suited for a scale length of 34 inches are used. However, with a through bridge, and additional run length of about 4-16 inches may created by positioning the strings through the orifice in the through bridge and anchor the string ball ends in the string return cavity on the rear side of the guitar body. As a result, this enables the bass guitar 300 to be able to handle string lengths of more than the intended scale length of 34 inches, e.g., 38- to 51-inch strings can be accommodated. With longer strings, one can achieve use of stiffer strings (e.g., larger diameter) that may be preferred when playing because of better responsiveness and playability. Further yet, with a longer scale length, a player may tune to lower notes without the physical impacts that result from using a shorter string's playability. That is, shorter strings exhibit less rigidity when tuned to lower notes, a drawback for some styles of playing. Generally speaking, the speaking length of any strings exhibits the same tension when tuned to the same note, however, with a longer non-speaking length, a larger diameter string can be accommodated such that greater rigidity (with the same tension) results in longer and more stable string vibration. Thus, notes will "ring" longer and be sustained at tone for a longer duration of time as the string rigidity is increased.

Along the same lines, having a portion of the string run-length disposed on the back of the body, one can reduce the scale length of the instrument at the neck while retaining the playing properties of a typical instrument scale. Thus, a typical 34-inch set of strings can have between 4 and 16 inches of the string disposed around the string return 337 and in the string return cavity 338 such that the head stock is closer to the body with a shorter scale neck. This may be particularly advantageous for players having shorter arms or smaller hands. Additionally, the instruments will be more compact and have a lighter overall weight, thereby making material use in construction more efficient. Further, with a shorter scale length on the front side of the guitar, one may use strings with a smaller-than-typical diameter, yet still achieve pleasing sounds.

Lastly, the innovative through-bridge may be retrofitted onto existing instruments to attain the benefits of longer strings and associated string tension affords to instruments with respect to versatility and playability. These advantages may be appreciated further with respect to the descriptions of various embodiments as discussed next with respect to FIGS. 5-11.

Figure 5A:
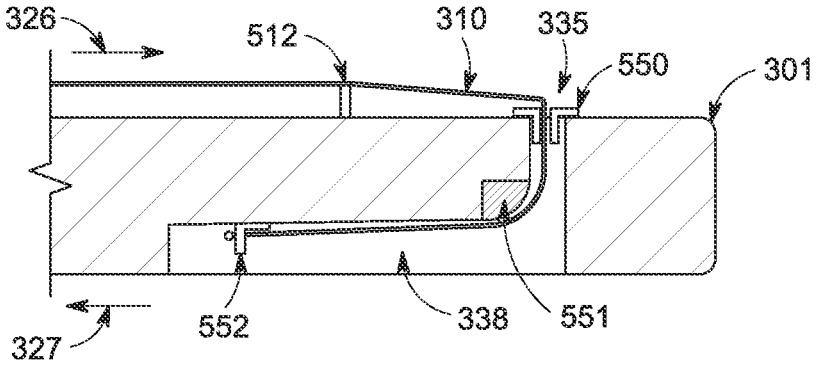
FIG. 5A-D are cutaway side views of the bass guitar of FIG. 3 showing embodiments of a through-bridges according to embodiments of the subject matter disclosed herein.

FIG. 5A-D are cutaway side views of the bass guitar body 301 of FIG. 3 showing embodiments of a through-bridges 335 according to embodiments of the subject matter disclosed herein. FIG. 5A shows a first embodiment of a through-bridge 335 showing a single string 310 emanating in the first direction 326, guided by a saddle 512, and disposed through a single return hole aperture 550. A skilled artisan understands that additional strings may also be disposed through respective return hole apertures, but one is shown here for ease of illustration. This embodiment further includes a metallic quarter round insert 551 that provides for a gradual return for translating the string to the opposite direction 327 where it is anchored in the string return cavity 338 by its ball end 553 engaged with a ball end retainer 552.

Using a through-bridge 335 as shown in FIG. 5A provides for a translation of the run length of the string 310 such that a large portion of the string 310 remains disposed on the front side of the instrument body 301, but a significant portion (e.g., 10%-30%) of the run length may be disposed on the backside of the instrument body 301 after the direction translation imparted by the through-bridge 335. As shown, the string is shown with a sharp turn into the aperture 550. This is for ease of illustration as the aperture 550 may induce a far more gradual translation (as can be seen from an embodiment described below with respect to FIG. 7. A more gradual direction translation reduces lateral stress on the string which leads to degraded performance and eventual failure.

Figure 5B:
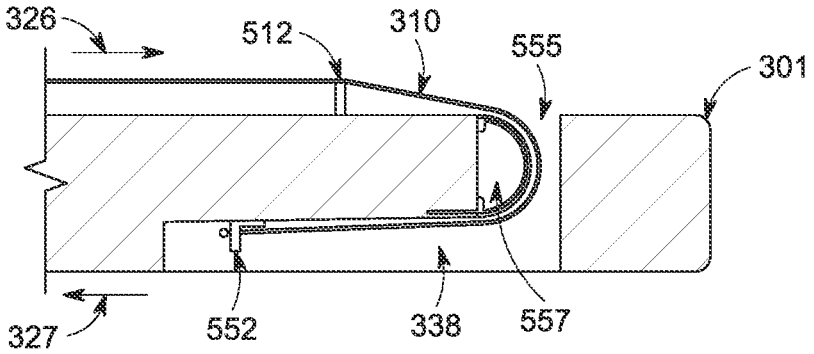

FIG. 5B shows a second embodiment of a through-bridge 335 showing a single string 310 emanating in the first direction 326, guided by a saddle 512, and disposed through an aggregate return aperture 555. A skilled artisan understands that additional strings may also be disposed through the aggregate return aperture 555, but one is shown here for ease of illustration. This embodiment further includes a metallic half-round return 557 that provides for a gradual return for translating the string to the opposite direction 327 where it is anchored in the string return cavity 338 by its ball end 553 engaged with a ball end retainer 552.

Using a through-bridge 335 as shown in FIG. 5B provides for a translation of the run length of the string 310 such that a large portion of the string 310 remains disposed on the front side of the instrument body 301, but a significant portion (e.g., 10%-30%) of the run length may be disposed on the backside of the instrument body 301 after the direction translation imparted by the through-bridge 335. Different form the embodiment of FIG. 5A, the half-round return 557 provides an even more gradual direction translation that reduces lateral stress on the string.

Figure 5C:
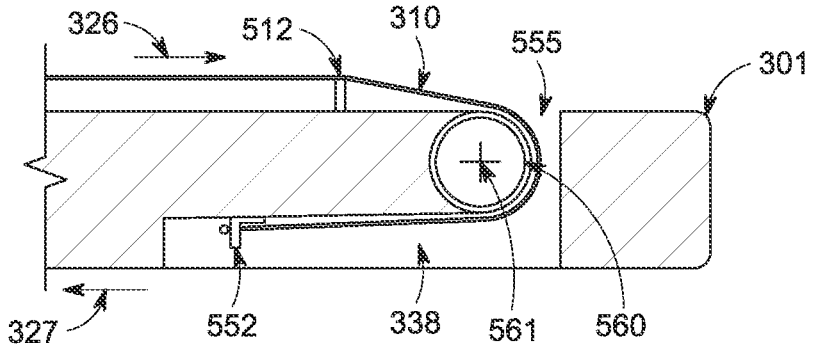

FIG. 5C shows a third embodiment of a through-bridge 335 showing a single string 310 emanating in the first direction 326, through the saddle 512, and disposed through an aggregate return aperture 555. This embodiment further includes a metallic full-round return 560 that provides for a gradual return for translating the string to the opposite direction 327 where it is anchored in the string return cavity 338 by its ball end 553 engaged with a ball end retainer 552.

Using a through-bridge 335 as shown in FIG. 5B provides for a gradual translation of the run length of the string 310. Different form the embodiment of FIG. 5A, the full-round return 560 provides an even more gradual direction translation that reduces lateral stress on the string. Also different from the embodiment of FIG. 5B, the full-round return 560 may be rotationally anchored about a rotation point 561 such that the return may rotate about this axis 561 in either direction to further reduces lateral stresses on the string.

Figure 5D:
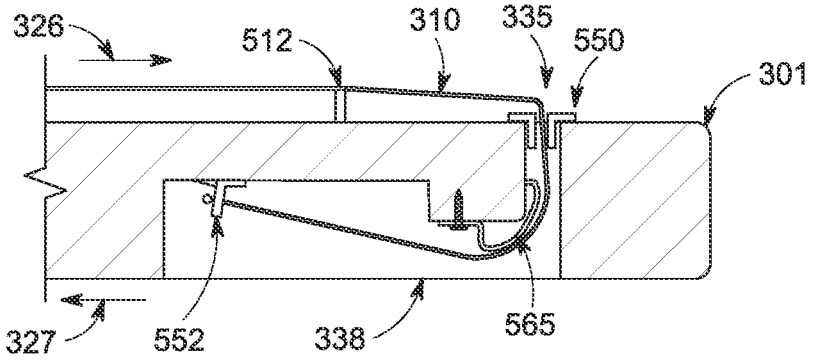

FIG. 5D shows a fourth embodiment of a through-bridge 335 showing a single string 310 emanating in the first direction 326, through the saddle 512, and disposed through a single return hole 550. This embodiment further includes a metallic oblong return 565 that provides for a gradual return for translating the string to the opposite direction 327 where it is anchored in the string return cavity 338 by its ball end 553 engaged with a ball end retainer 552.

Figure 6A:
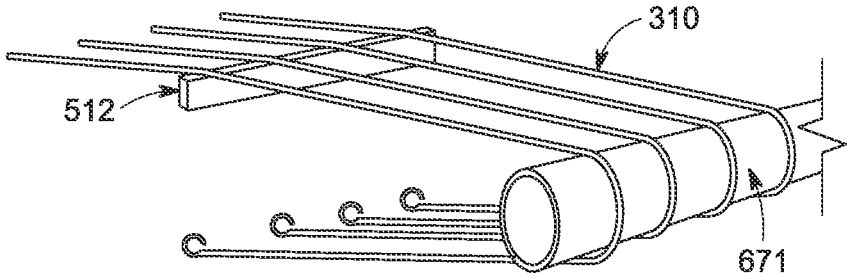
FIG. 6A-B are isometric cutaway views of the bass guitar of FIG. 3 showing additional embodiments of a through-bridge return according to embodiments of the subject matter disclosed herein.
Figure 6B:
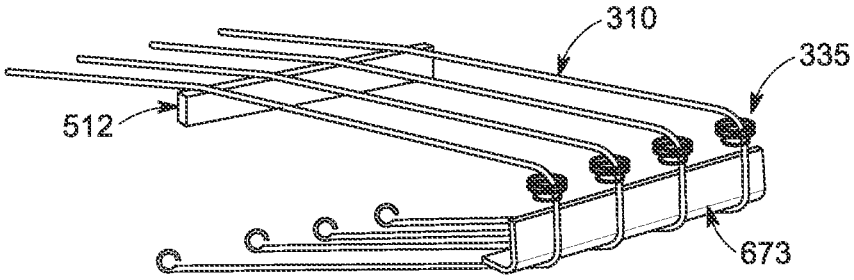

FIG. 6A-C are isometric cutaway views of the bass guitar of FIG. 3 showing additional embodiments of a through-bridge returns according to embodiments of the subject matter disclosed herein. FIG. 6A shows another embodiment of an oval-shaped cylinder return 671 that is part of a through-bridge 335 showing four strings 310 emanating in the first direction 326, through the saddle 512, and disposed through an aperture (not shown). A skilled artisan understands more or fewer strings may also be disposed through respective return hole apertures. This embodiment further includes a metallic oval-shaped cylinder 671 that provides for a gradual return for translating the strings 310 to the opposite direction 327.

FIG. 6B shows another embodiment of hybrid through-bridge 335 having individual hole returns 672 as well as an L-shaped metallic return 673. This embodiment shows four strings 310 emanating in the first direction 326, through the saddle 512, and disposed through an aperture (not shown). This embodiment includes an L-shaped metallic return 673 that provides for a gradual return for translating the strings 310 to the opposite direction 327.

Figure 7:
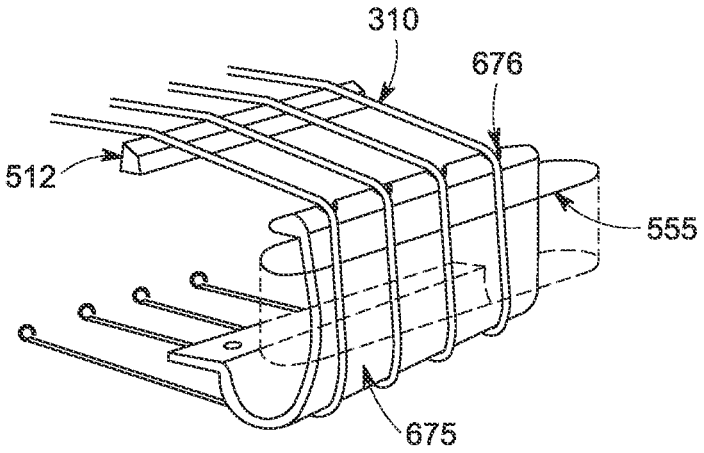
FIG. 7 is an isometric cutaway view of the bass guitar of FIG. 3 showing a monolithic return for a through-bridge according to an embodiment of the subject matter disclosed herein.

FIG. 7 shows another embodiment of a monolithic return 675 that is part of a through-bridge 335 shown here as guiding (via string guide notches 676) four strings 310 emanating in the first direction 326, guided by a saddle 512, and disposed through an aperture 355. This embodiment provides a monolithic return 675 that provides for a gradual direction translation at a top-side point 678 near string guide notches and then another gradual direction translation at a bottom-side point 679 for translating the strings 310 to the opposite direction 327. This through-bridge embodiment may also be well suited to be an external bridge translator (not shown). In such an embodiment, the monolithic return 675 is disposed on a far side of a guitar body wherein the strings simply wrap around the edge of the guitar body to culminate at an anchor point on the back side of the body.

Figure 8:
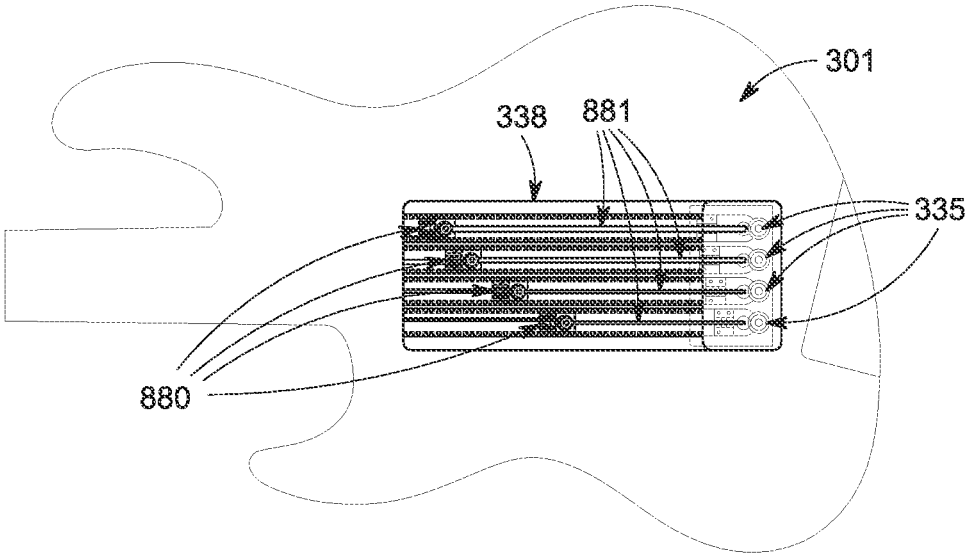
FIG. 8 is a rear view of a stringed instrument having a first embodiment of an adjustable anchor system for translated strings according to an embodiment of the subject matter disclosed herein.

FIG. 8 is a rear view of a stringed instrument having a first embodiment of an adjustable anchor system for translated strings according to an embodiment of the subject matter disclosed herein. As shown here, the rear side of a stringed instrument body 301 reveals a string return cavity 338 having strings 310 anchored therein. The strings are shown extended through a set of four individual orifices 335 that are part of a through-bridge. In embodiments not shown here, the through-bridge may have a single orifice and utilize one or more return designs as shown and discussed above with respect to FIG. 5A-D, 6A-B, or 7.

Each string 310 may be anchored at a respective adjustable anchor position along a dedicated string anchor track 881 using a string anchor device 880. Each string anchor track 881 may be disposed in the string return cavity 338 and include a series of "teeth" on either side of a string anchor track 881. These teeth provide a number of discrete positions in which a string anchor device 880 may be secured. The string anchor device 880 includes a circular receptacle for holding a string ball end in place while the string 310 may extend through an aperture back toward the through-bridge. Further, each string anchor device 880 includes protrusions lateral from the circular receptacle and suited to engage a discrete set of teeth in its respective string anchor track 881. In this manner, each string ball end may be anchored at one of a plurality of discrete positions along the string anchor track 881 using the string anchor device 880.

In the embodiment shown in FIG. 8, the string anchor tracks 881 may be a single assembled unit such that the four string-anchor tracks 881 are mounted as a single unit inside the string return cavity 338. In other embodiments, each string anchor track 881 may be individually mounted. Having relatively small differences in overall string anchor position (because of the relatively small teeth) allows for a high level of tension versatility for a player. Generally, anchoring a string 310 closer to the through-bridge reduces the tension in the string 310 and anchoring a string 310 further from the through-bridge increases the tension in the string. Yet another advantage of these variable anchor points includes the ability of a player to personalize stiffness options of strings 310 because of string anchoring points 880. Having a variable anchor point for each string 310 also enables a player to achieve benefits of a multi-scale stringed instrument with a mono-scaled instrument.

Figure 9:
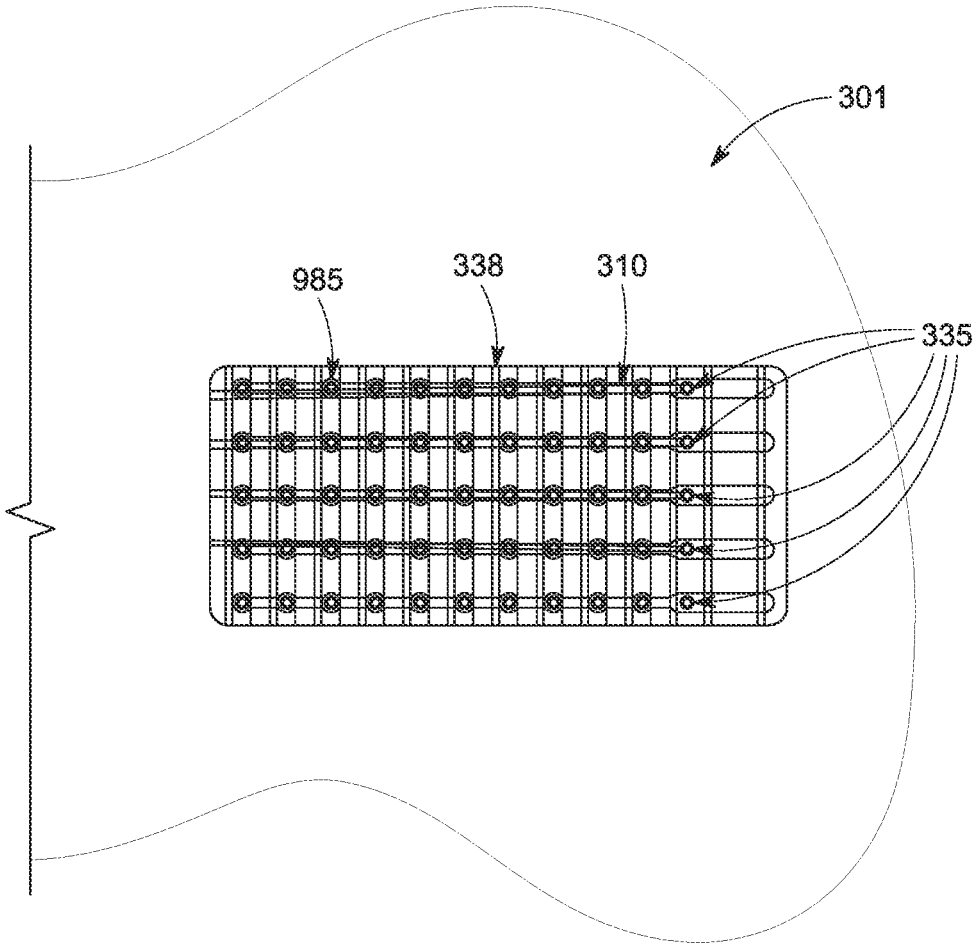
FIG. 9 is a rear view of a stringed instrument having a second embodiment of an adjustable anchor system for translated strings according to an embodiment of the subject matter disclosed herein.

FIG. 9 is a rear view of a stringed instrument having a second embodiment of a matrix anchor system 985 for translated strings according to an embodiment of the subject matter disclosed herein. As shown here, the rear side of a stringed instrument body 301 reveals a string return cavity 338 having strings 310 anchored therein using a single adjustable anchor system 985. The strings 310 are shown extended through a set of four individual orifices 335 that are part of a through-bridge. In embodiments not shown here, the through-bridge may have a single orifice and utilize one or more return designs as shown and discussed above with respect to FIG. 5A-D, 6A-B, or 7.

Each string 310 may be anchored at a respective discrete anchor position along a respective set of string anchor termination point within the matrix of termination points in the matrix anchor system 985. As before, each string culminates in a string ball end designed to engage an anchor point or anchor device. In this embodiment, several different anchor points are part of the design of the matrix anchor system 985. That is, the ball end may be set into one of several different position options (e.g., ball-end receivers or "dots" as shown in the matrix anchor system 985). These ball-end receivers provide a number of discrete positions in which a string ball-end may be secured. Like the embodiment of FIG. 8, each receiver includes a circular receptacle for holding a string ball-end in place while the string 310 may extend through an aperture back toward the through-bridge.

In the embodiment shown in FIG. 9, the matrix anchor system 985 may be a single extruded unit such that the four sets of ball-end receivers are part of a single monolithic unit. Having discrete differences in overall string anchor position (because of discrete receiver positions) allows for a high level of tension versatility for a player. As before, anchoring a string 310 closer to the through-bridge reduces the tension in the string 310 and anchoring a string 310 further from the through-bridge increases the tension in the string. Having a variable anchor point for each string 310 also enables a player to achieve benefits of a multi-scale stringed instrument with a mono-scaled instrument.

Figure 10:
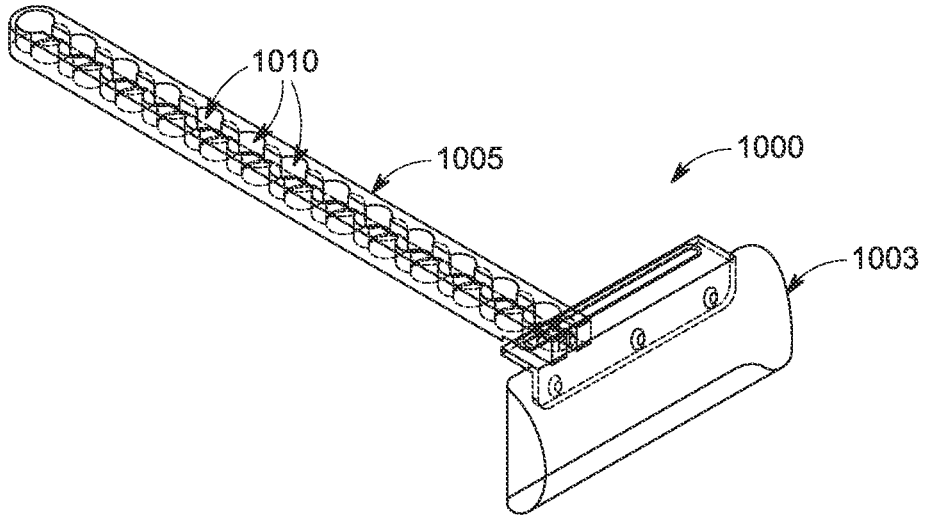
FIG. 10 is an isometric view of a monolithic single-string anchor system according to an embodiment of the subject matter disclosed herein.

FIG. 10 is an isometric view of a monolithic single-string anchor system 1000 according to an embodiment of the subject matter disclosed herein. In this embodiment, a similar device to the embodiment of FIG. 9 is shown wherein the concept of providing tension adjustment to only one string is achieved. Thus, the string 310 may be anchored at a respective discrete anchor position along a respective set of string anchor termination points within the linear array 1005 of termination points 1010 in the single-string anchor system 1000. As before, each string culminates in a string ball end designed to engage an anchor point or anchor device. In this embodiment, several different anchor points 1010 are part of the design of the linear array. That is, the ball end may be set into one of several different ball-end receivers 1010. These ball-end receivers provide a number of discrete positions in which a string ball-end may be secured wherein each receiver includes a circular receptacle for holding a string ball-end in place while the string 310 may extend through an aperture back toward the through-bridge.

In the embodiment shown in FIG. 10, the single-string anchor system 1000 may be a single extruded unit such that the set of ball-end receivers 1010 are part of a single monolithic unit together with a string return 1003 that may be mounted in the through-bridge Having discrete differences in overall string anchor position (because of discrete receiver positions) allows for a high level of tension versatility for a player. Having a variable anchor point for each string 310 also enables a player to achieve benefits of a multi-scale stringed instrument with a mono-scaled instrument.

Figure 11:
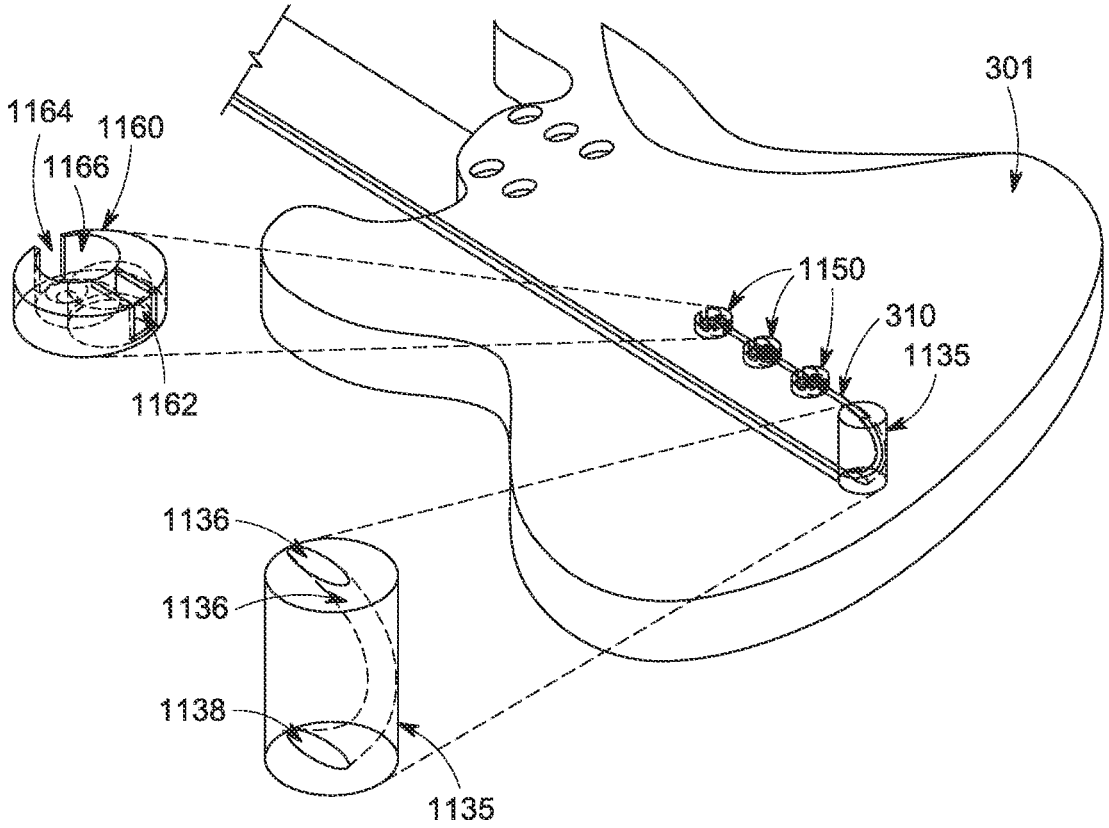
FIG. 11 is an isometric view of a modular string tension adjustment system according to an embodiment of the subject matter disclosed herein.

FIG. 11 is an isometric view of a modular string tension adjustment system according to an embodiment of the subject matter disclosed herein. Generally, the modular string tension adjustment system comprises a cylinder string return 1135 in conjunction with a string anchor puck 1160. As with embodiment described previously, a string 310 may be translated through the cylinder string return 1135 to the back side of an instrument body 301. Once translated, the string may be anchored by a string anchor puck 1160 that is placed in one of several discrete circular cavities 1150 that are disposed on the back side of the instrument body.

This embodiment is "modular" in that an instrument may be easily retrofitted on a per string basis with the elements of the system. Thus, a hole may be drilled through the body to house the cylindrical string return and cavities may be carved into the body 301 for a number of possible locations to secure one or more string anchor pucks. The cylinder string return is characterized as having a "top" side disposed adjacent to the front of an instrument (e.g., the front of the body, where a string may be threaded through a top-side aperture 1136. The string then extends through the cylinder body via an internal pathway 1137 to then emerge out a bottom-side aperture 1138 that is aligned in the plane of the backside of the instrument body 301. Thus, the string 310 is translated to extend in the opposite direction in which the string entered the top-side aperture 1136. After translation, the string 310 may be anchored at string anchor puck 1160 disposed in a circular cavity 1150. string anchor puck 1160 includes, similar to embodiments of FIG. 8-10, a circular receiver 1136 for holding a string ball-end in place while the string 310 may extend through an aperture 1162 back toward the through-bridge. There is also an aperture 1164 on the "front-side" of the circular receiver 1136 such that the string may extend to a different anchor point further away from the through-bridge. In this manner, each system may include several string anchor pucks 1160 wherein one of them is used to anchor the string. Further, other strings may be anchored in a conventional manner giving additional versatility (as discussed throughout) for less than all of the strings.

The use of the terms "a" and "an" and "the" and similar referents in the specification and in the following claims are to be construed to cover both the singular and the plural, unless otherwise indicated herein or clearly contradicted by context. The terms "having," "including," "containing" and similar referents in the specification and in the following claims are to be construed as open-ended terms (e.g., meaning "including, but not limited to,") unless otherwise noted. Recitation of ranges of values herein are merely indented to serve as a shorthand method of referring individually to each separate value inclusively falling within the range, unless otherwise indicated herein, and each separate value is incorporated into the specification as if it were individually recited herein. All methods described herein can be performed in any suitable order unless otherwise indicated herein or clearly contradicted by context. The use of any and all examples, or exemplary language (e.g., "such as") provided herein, is intended merely to better illuminate embodiments and does not pose a limitation to the scope of the disclosure unless otherwise claimed. No language in the specification should be construed as indicating any non-claimed element as essential to each embodiment of the present disclosure.

Different arrangements of the components depicted in the drawings or described above, as well as components and steps not shown or described are possible. Similarly, some features and sub-combinations are useful and may be employed without reference to other features and sub-combinations. Embodiments have been described for illustrative and not restrictive purposes, and alternative embodiments will become apparent to readers of this patent. Accordingly, the present subject matter is not limited to the embodiments described above or depicted in the drawings, and various embodiments and modifications can be made without departing from the scope of the claims below.

That which is claimed is:

1. A stringed instrument, comprising:

a body having a first side facing a first direction and a second side facing a second direction that is opposite the first direction;

a first string anchor point disposed on a portion of the instrument that is disposed on a same side as the first side of the body;

a second string anchor point disposed on the second side, the second string anchor point having an adjustable anchor location; and a plurality of strings disposed taut between the first anchor point and the second anchor point.

2. The stringed instrument of claim 1, further comprising an aperture in the body through which at least one of the plurality of strings is disposed.

3. The stringed instrument of claim 2, wherein a distance between the first anchor point and the aperture is 5 to 10 times greater than a distance between the aperture and the second anchor point.

4. The stringed instrument of claim 1, further comprising an aperture having a metal return configured to translate the plurality of strings from a first direction to a second direction.

5. The stringed instrument of claim 1, further comprising a cavity disposed on the second side and having the second anchor point disposed in the cavity.

6. The stringed instrument of claim 1, further comprising an electronic pickup disposed adjacent to the plurality of strings on the first side.

7. The stringed instrument of claim 1, further comprising an electronic pickup disposed adjacent to the plurality of strings on the second side.

8. The stringed instrument of claim 1, wherein the stringed instrument comprises a stringed instrument from the group composed of an electric guitar, an electric bass guitar, an electric banjo, an electric violin, an electric viola, an electric cello, and an electric mandolin.

9. The stringed instrument of claim 1, wherein the plurality of stings comprises between 3 and 12 strings.

10. A stringed instrument, comprising:

a body coupled to a head stock via a neck;

a first anchor device disposed on the head stock configured to be adjusted by an operably attached tuning key;

a second anchor device disposed on the body having an adjustable anchor point configured to be maneuvered between a plurality of discrete anchor positions; and a string disposed taut between the first anchor point and the second anchor point.

11. The stringed instrument of claim 10, wherein the second anchor device is disposed on a side of the instruments that is opposite a side of the instrument in which the first anchor device is disposed and wherein the string is disposed through an aperture in the body, the aperture further comprising a return.

12. The stringed instrument of claim 10, wherein the second anchor device further comprises an adjustable anchor track having a plurality of discrete anchor track positions, each anchor track position configured to secure a track device suited to engage a string ball end of the string.

13. The stringed instrument of claim 10, wherein the second anchor device further comprises a matrix of anchor positions that includes a plurality of discrete ball-end receivers suited to engage a string ball end of the string.

14. The stringed instrument of claim 10, wherein the second anchor device further comprises a linear array of anchor positions that includes a plurality of discrete ball-end receivers suited to engage a string ball end of the string, the linear array further coupled to a string return.

15. The stringed instrument of claim 10, wherein the second anchor device further comprises:

a modular anchor puck having a ball-end receiver suited to engage a string ball end of the string;

a circular cavity disposed in the body configured to secure the modular anchor puck; and a cylindrical string return insert disposed in the body and configured to translate the string to the second anchor device.

* * * * *